US010273760B2

(12) United States Patent
Cook et al.

(10) Patent No.: US 10,273,760 B2
(45) Date of Patent: Apr. 30, 2019

(54) ORIENTATION SYSTEM AND METHOD

(71) Applicants: Robert Bradley Cook, Mandeville, LA (US); Glenn Mitchel Walls, Madisonville, LA (US)

(72) Inventors: Robert Bradley Cook, Mandeville, LA (US); Glenn Mitchel Walls, Madisonville, LA (US)

( * ) Notice: Subject to any disclaimer, the term of this patent is extended or adjusted under 35 U.S.C. 154(b) by 255 days.

(21) Appl. No.: 15/385,370

(22) Filed: Dec. 20, 2016

(65) Prior Publication Data

US 2018/0171725 A1 Jun. 21, 2018

(51) Int. Cl.
*E21B 17/043* (2006.01)
*E21B 17/046* (2006.01)
*E21B 17/04* (2006.01)

(52) U.S. Cl.
CPC ..... *E21B 17/04* (2013.01)

(58) Field of Classification Search
CPC ..... E21B 17/042; E21B 17/0423; E21B 17/0426; E21B 17/043; E21B 17/046
USPC ..... 166/242.6
See application file for complete search history.

(56) References Cited

U.S. PATENT DOCUMENTS

| | | | | |
|---|---|---|---|---|
| 387,475 | A * | 8/1888 | Whaling | E21B 17/043 279/100 |
| 2,296,198 | A * | 9/1942 | Boynton | E21B 17/046 285/111 |
| 2,314,867 | A * | 3/1943 | Boynton | E21B 17/046 285/111 |
| 7,213,655 | B2 * | 5/2007 | Parrott | E21B 17/04 166/240 |
| 7,793,994 | B2 * | 9/2010 | Boyd | E21B 17/04 285/330 |
| 2013/0146305 | A1 * | 6/2013 | Dupal | E21B 19/16 166/380 |

* cited by examiner

*Primary Examiner* — Kenneth L Thompson
(74) *Attorney, Agent, or Firm* — Jones Walker LLP

(57) ABSTRACT

An orientation system includes an upper sub, a lower sub, and an orienting sleeve for rotationally aligning the upper sub with a rotational position of the lower sub. The orienting sleeve includes a keyed upper surface configured to engage a keyed lower surface of the upper surface, and an inner faceted portion configured to engage an outer faceted portion of the lower sub. The orientation system further includes an upper sleeve configured for attachment to the orienting sleeve and the upper sub, and a lower sleeve configured for attachment to the orienting sleeve and the lower sub. The upper and lower sleeves secure the upper sub to the lower sub.

20 Claims, 12 Drawing Sheets

ORIENTATION SYSTEM AND METHOD

BACKGROUND

Two or more tools are routinely connected in sequence in a tubular string for use in a wellbore. Conventionally, threaded connections are used to secure the tools to one another and to secure each tool to the tubular string. Certain applications require that a particular torque be applied to the threaded connection between the tools or between each tool and the tubular string. For example, some manufacturers provide torque specifications needed to achieve a fluid-tight connection. If rotational alignment of the sequential tools is required, it is difficult to achieve both the required torque on each threaded connection and the rotational alignment between the sequential tools.

DETAILED DESCRIPTION OF SELECTED EMBODIMENTS

Figure 1:
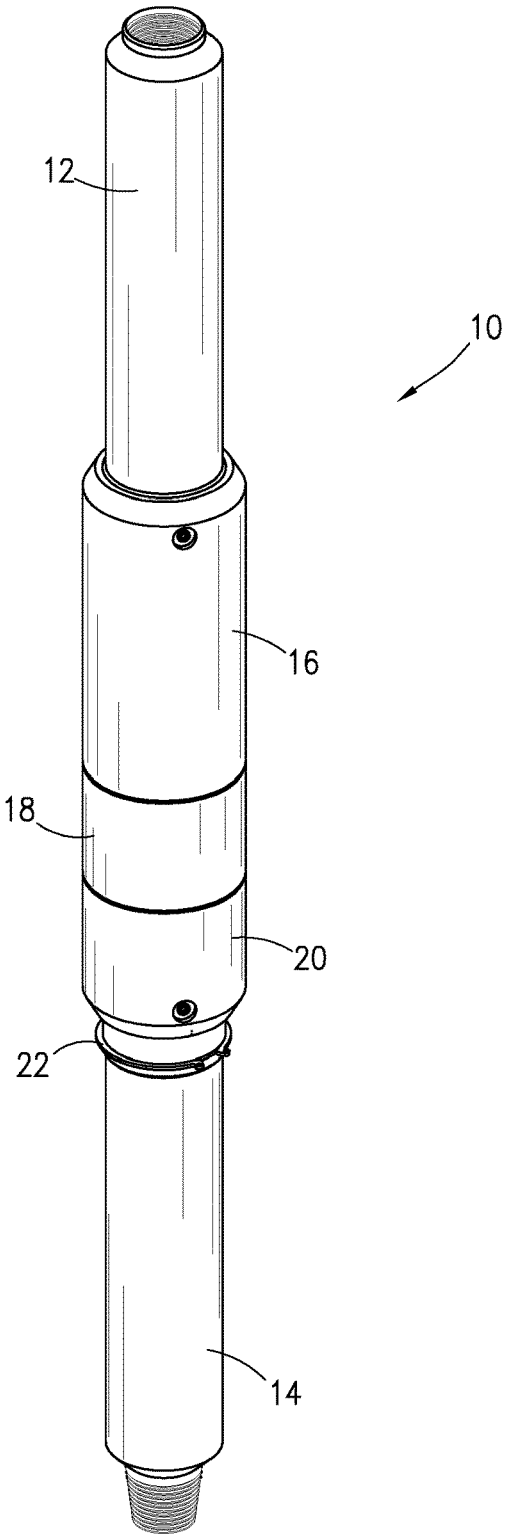
FIG. 1 is a perspective view of an orientation system.

Orientation system 10 illustrated in FIG. 1 allows a high torque connection between an upper member and a lower member independent from the relative rotational positions of the upper member and the lower member. As used herein, "member" means any a tool, work string tubular, or other tubular component that may be used in a wellbore. Orientation system 10 may include upper sub 12 and lower sub 14. Upper sub 12 may be attached to the upper member with high torque, and lower sub 14 may be separately attached to the lower member with high torque. For example, rig tongs may be used for these high torque connections. Upper sleeve 16, orienting sleeve 18, and lower sleeve 20 may be disposed around upper and lower subs 12, 14 to connect upper and lower subs 12, 14 with any desired rotational alignment of the upper member relative to the lower member. As described in more detail below, orienting sleeve 18 may engage upper sub 12 and lower sub 14 to rotationally align upper sub 12 relative to a rotational position of lower sub 14. Upper and lower sleeves 16, 20 may be used to secure upper sub 12 to lower sub 14. In one embodiment, orienting sleeve 18 is connected to upper and lower sleeves 16, 20, which are secured to upper and lower subs 12, 14, respectively. Orientation system 10 may also include retaining mechanism 22 disposed within a groove in an outer surface of lower sub 14. Retaining mechanism 22 may include a split ring, a screw, or any other mechanism capable of preventing lower sleeve 20 from sliding off of lower sub 14. In an alternate embodiment, orientation system 10 includes no retaining mechanism 22. Orientation system 10 achieves any desired rotational alignment of the upper member relative to the lower member without sacrificing torque in the connection between the upper member and the lower member.

Figure 2:
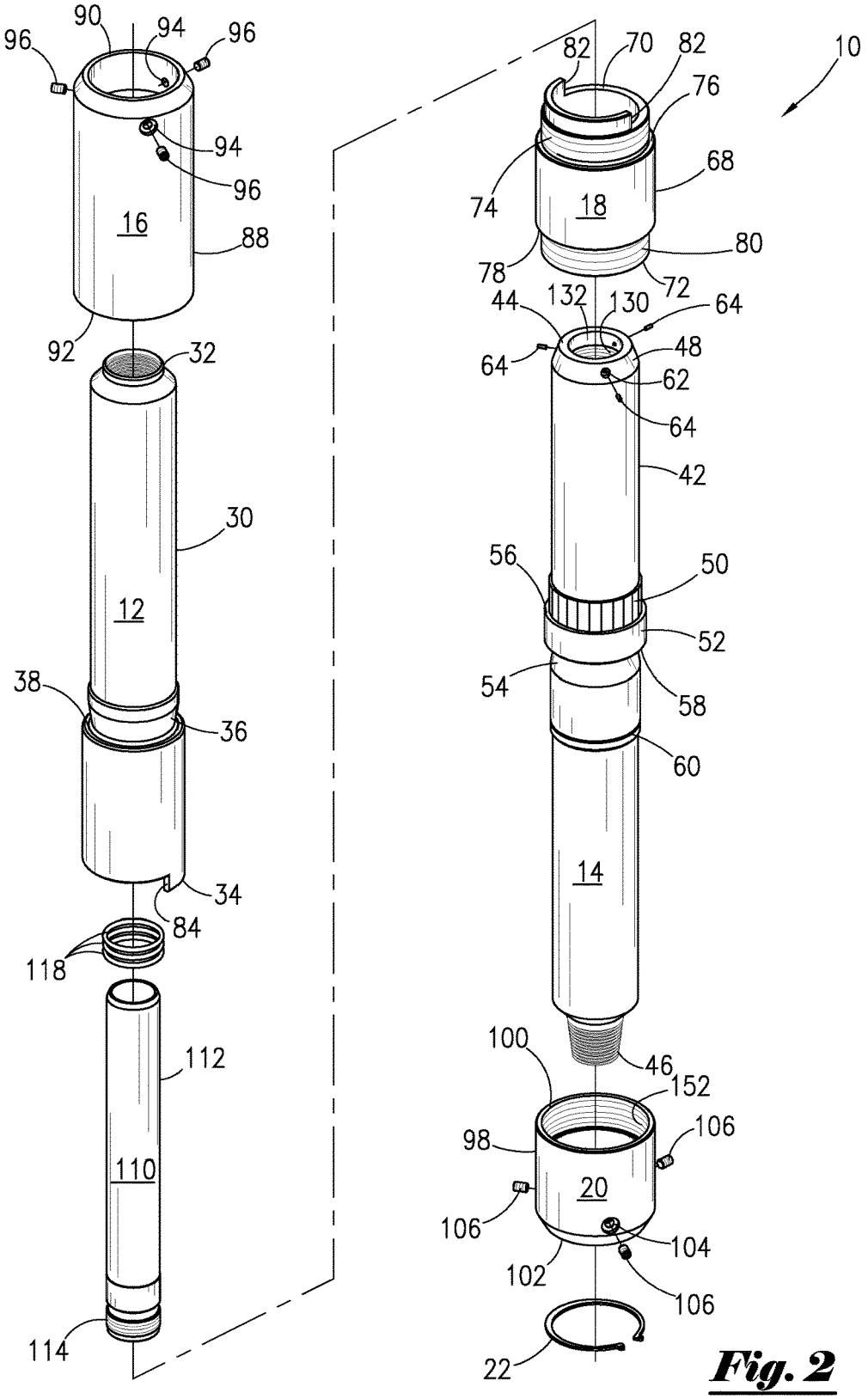
FIG. 2 is an exploded view of the orientation system.
Figure 3A:
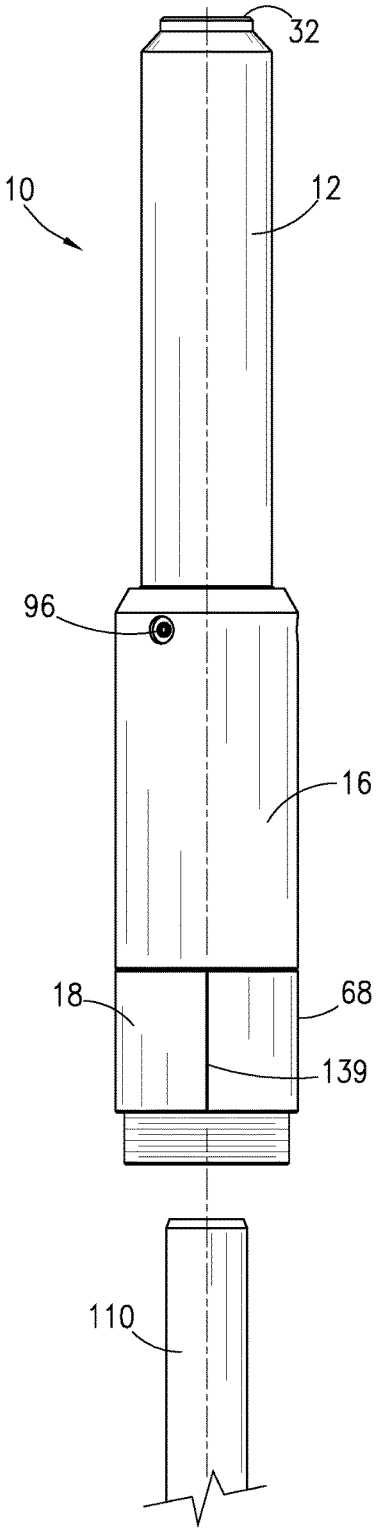
FIGS. 3A and 3B show a sequential side view of the orientation system after a first step in an assembly process for the orientation system.
Figure 3B:
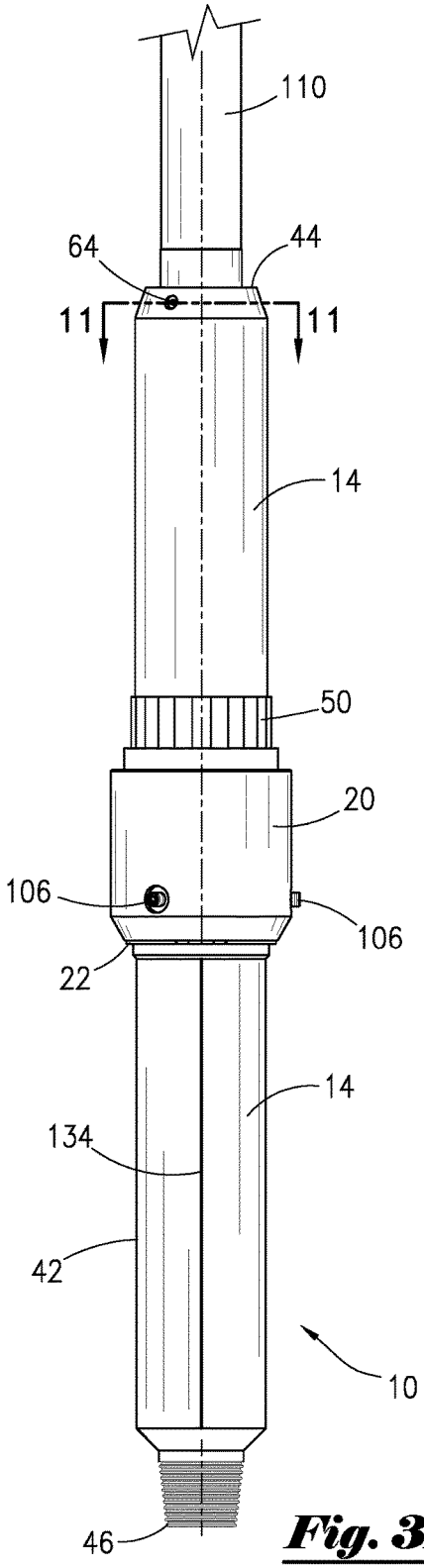

As shown in FIG. 2, each of the components may have a generally cylindrical shape including an outer surface and an inner bore. Outer surface 30 of upper sub 12 may extend from upper end 32 to keyed lower surface 34. Outer surface 30 may include tapered section 36 above shoulder 38. Outer surface 42 of lower sub 14 may extend from upper end 44 to lower end 46. Outer surface 42 may include tapered surface 48 near upper end 44, outer faceted portion 50, extended section 52 below outer faceted portion 50, and tapered section 54 below extended section 52. Outer faceted portion 50 may include a plurality of flat surfaces around the circumference of lower sub 14. Outer faceted portion 50 may include any number of flat surfaces, such as, but not limited to, between 2 and 70 flat surfaces. Extended section 52 forms upper shoulder 56 below outer faceted portion 50 and lower shoulder 58 above tapered section 54. Outer surface 42 of lower sub 14 may also include groove 60 configured to receive retaining mechanism 22. Tapered surface 48 near upper end 44 may include one or more lateral bores 62 each configured to receive a set screw 64.

With reference still to FIG. 2, outer surface 68 of orienting sleeve 18 may extend from keyed upper surface 70 to lower surface 72. Outer surface 68 may include threaded upper portion 74, upper shoulder 76 below threaded upper portion 74, lower shoulder 78, and threaded lower end 80 below lower shoulder 78. Keyed upper surface 70 of orienting sleeve 18 may be configured to engage keyed lower surface 34 of upper sub 12. In one embodiment, keyed upper surface 70 and keyed lower surface 34 are reciprocally shaped. For example, keyed upper surface 70 and keyed lower surface 34 may include reciprocal shoulders. Keyed upper surface 70 may include at least two shoulders 82, and keyed lower surface 34 may include at least two reciprocal shoulders 84. In other embodiments, keyed upper surface 70 and keyed lower surface 34 may include any configuration of reciprocally shaped surfaces capable of rotationally aligning upper sub 12 with orienting sleeve 18.

As shown in FIG. 2, outer surface 88 of upper sleeve 16 may extend from upper end 90 to bottom surface 92. Outer surface 88 may include one or more lateral bores 94 each configured to receive a set screw 96. Similarly, outer surface 98 of lower sleeve 20 may extend from top surface 100 to lower end 102. Outer surface 98 may include one or more lateral bores 104 each configured to receive a set screw 106. Retaining mechanism 22 may be formed of a split ring configured to fit into groove 60 in outer surface 42 of lower sub 14 to retain lower sleeve 20 around lower sub 14, as described in more detail below. Orientation system 10 may further include mandrel 110 including an outer surface 112 having threaded lower end 114. One or more seal members 118 may be disposed within an inner bore of upper sub 12, as described in more detail below. Seal members 118 may be formed of any component, structure, or material capable of providing a fluid seal, such as, but not limited to, elastomeric O-rings. In an alternate embodiment, mandrel 110 is formed continuously with lower sub 14. All components of orientation system 10 may be formed of alloy steel or any other high strength and durable material.

FIGS. 3A-10B illustrate steps in an assembly process for orientation system 10. The assembly process may be used to connect an upper member and a lower member in a tubular string to achieve a desired rotational orientation of the upper member relative to the lower member and to achieve a required torque specification over the connection.

Figure 11:
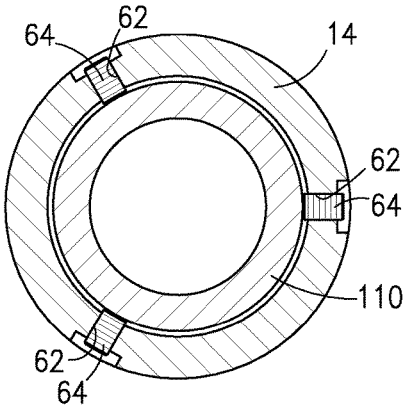
FIG. 11 is a lateral sectional view of the orientation system taken along line 11-11 in FIG. 3B.

Referring first to FIGS. 3A-4B, the first step in the assembly process for orientation system 10 (for embodiments having mandrel 110 formed separately from lower sub 14) includes threadedly connecting mandrel 110 to upper end 44 of lower sub 14 by connecting threaded lower end 114 of mandrel 110 within threaded upper portion 130 of inner bore 132 of lower sub 14. Set screws 64 may be positioned in lateral bores 62, and tightened to engage mandrel 110, thereby securing mandrel 110 to lower sub 14 as shown in FIG. 11.

The first step of the assembly process may also include sliding lower sleeve 20 over lower sub 14 from lower end 46, and securing retaining mechanism 22 in groove 60 of lower sub 14 to retain lower sleeve 20 around lower sub 14. Set screws 106 may be positioned in lateral bores 104 in lower sleeve 20, but may remain in a loosened position such that lower sleeve 20 may slide along lower sub 14 and rest on retaining mechanism 22. In this position, mandrel 110 may extend above upper end 44 of lower sub 14 and outer faceted portion 50 of lower sub 14 may be exposed. Lower sub 14 may then be attached to a lower member (not shown). Lower sub 14 and the lower member are secured together with a desired torque specification over the connection. Alignment mark 134 may be added to outer surface 42 of lower sub 14 based on a rotational position of the lower member.

The first step of the assembly process may further include sliding upper sleeve 16 over upper sub 12 from upper end 32, and positioning orienting sleeve 18 below upper sub 12 such that keyed lower surface 34 of upper sub 12 engages keyed upper surface 70 of orienting sleeve 18. Upper sleeve 16 may then be threadedly connected to orienting sleeve 18 by connecting threaded lower end 136 of upper sleeve 16 to threaded upper portion 74 of orienting sleeve 18. Set screws 96 may be positioned in lateral bores 94 of upper sleeve 16, and fully tightened such that set screws 96 engage tapered section 36 of upper sub 12. In this way, set screws 96 retain upper sleeve 16 around upper sub 12 with inner shoulder 138 of upper sleeve 16 engaging shoulder 38 of upper sub 12, thereby operatively connecting orienting sleeve 18 to upper sub 12. In this arrangement, it is not possible for upper sleeve 16 to unthread from orienting sleeve 18 due to the direction of tapered section 36 of upper sub 12 (i.e., the diameter of tapered section 36 decreases in the threading direction). Upper sub 12 may then be attached to an upper member (not shown). Upper sub 12 and the upper member are secured together with a desired torque specification over the connection. Alignment mark 139 may be added to outer surface 68 of orienting sleeve 18 based on a rotational position of the upper member.

Figure 4A:
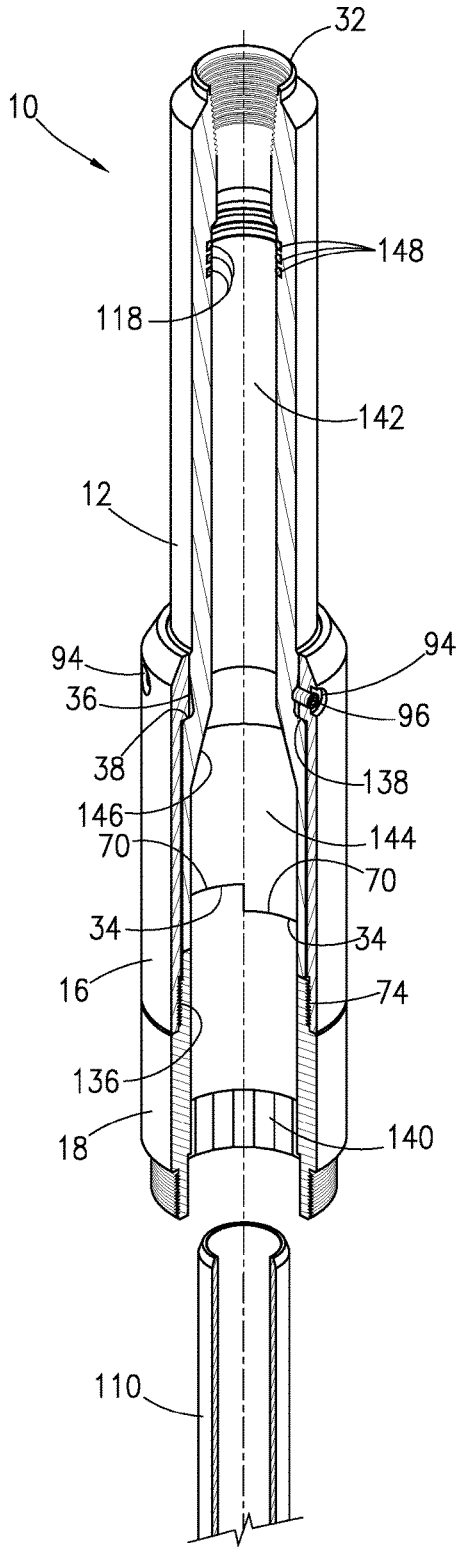
FIGS. 4A and 4B show a sequential perspective cutaway view of the orientation system after the first step in the assembly process.
Figure 4B:
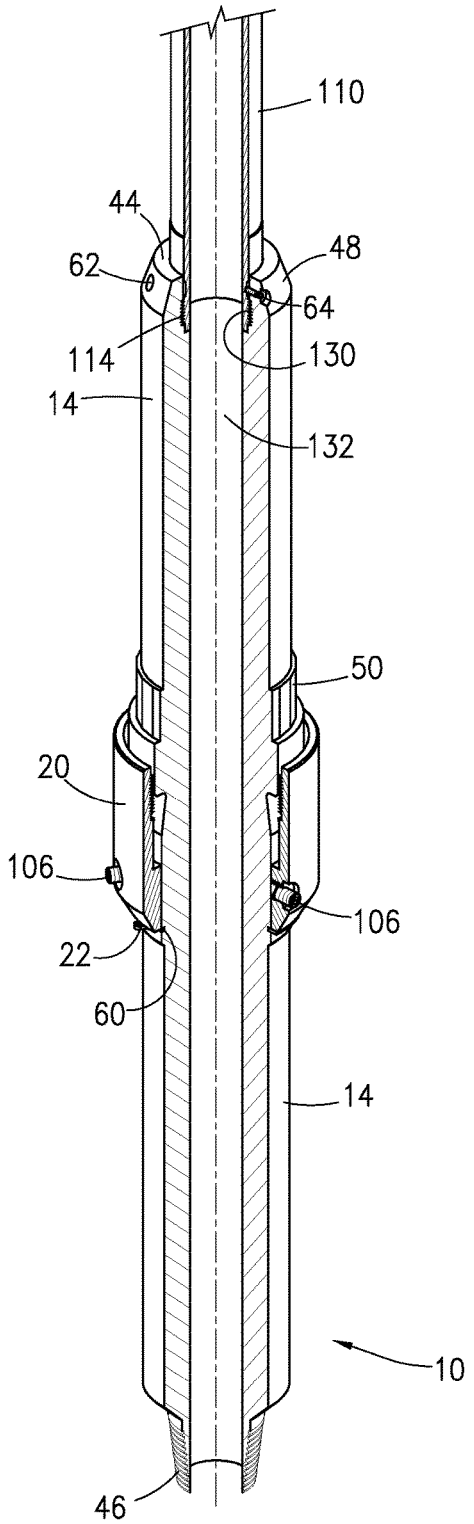
Figure 5A:
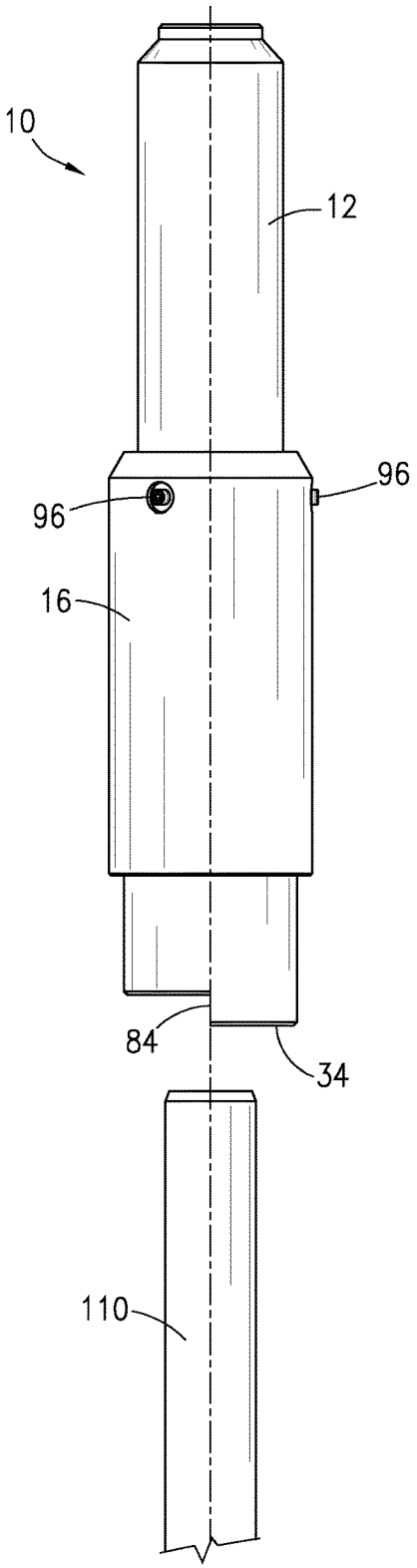
FIGS. 5A and 5B show a sequential side view of the orientation system after a second step in the assembly process.
Figure 5B:
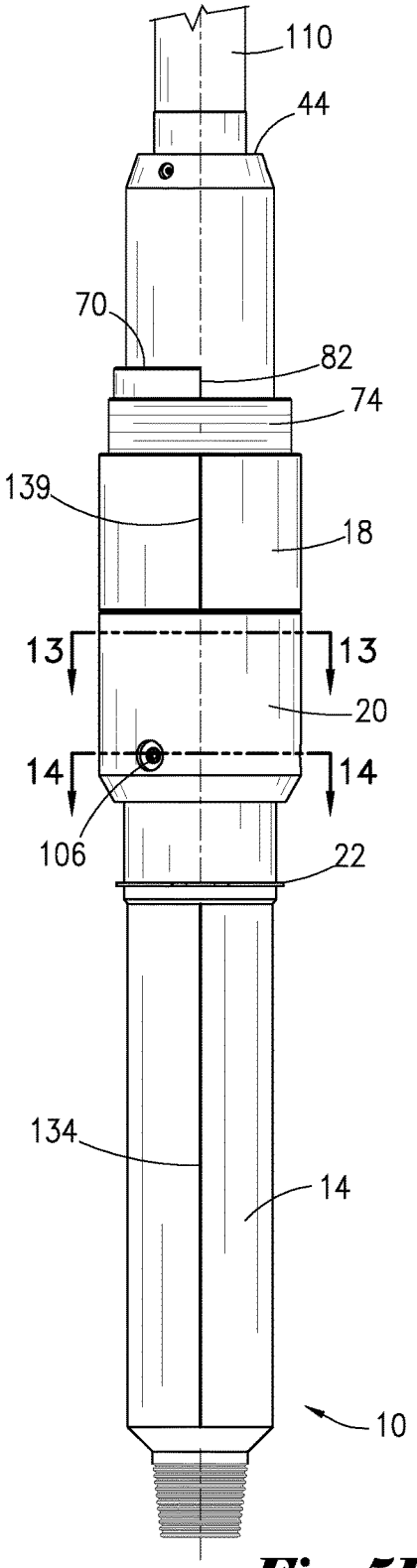
Figure 6A:
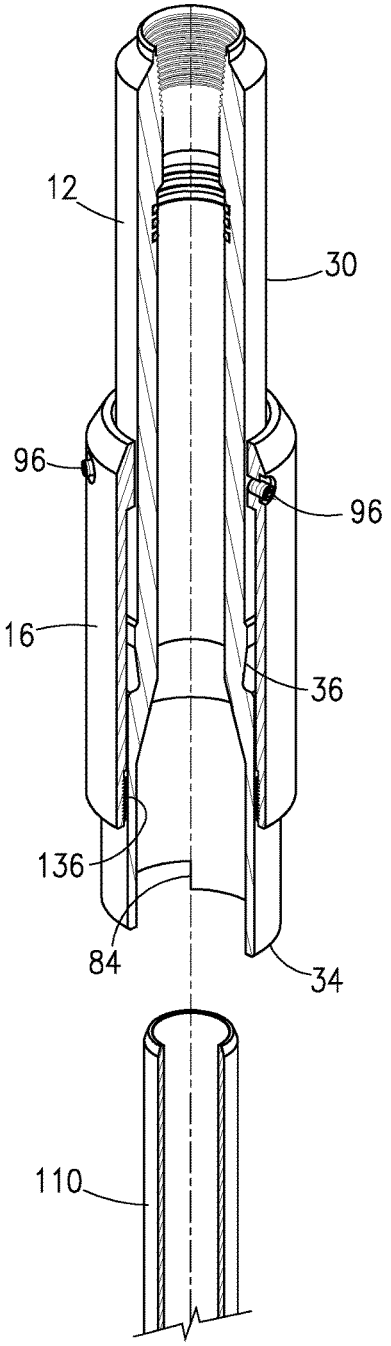
FIGS. 6A and 6B show a sequential perspective cutaway view of the orientation system after the second step in the assembly process.
Figure 6B:
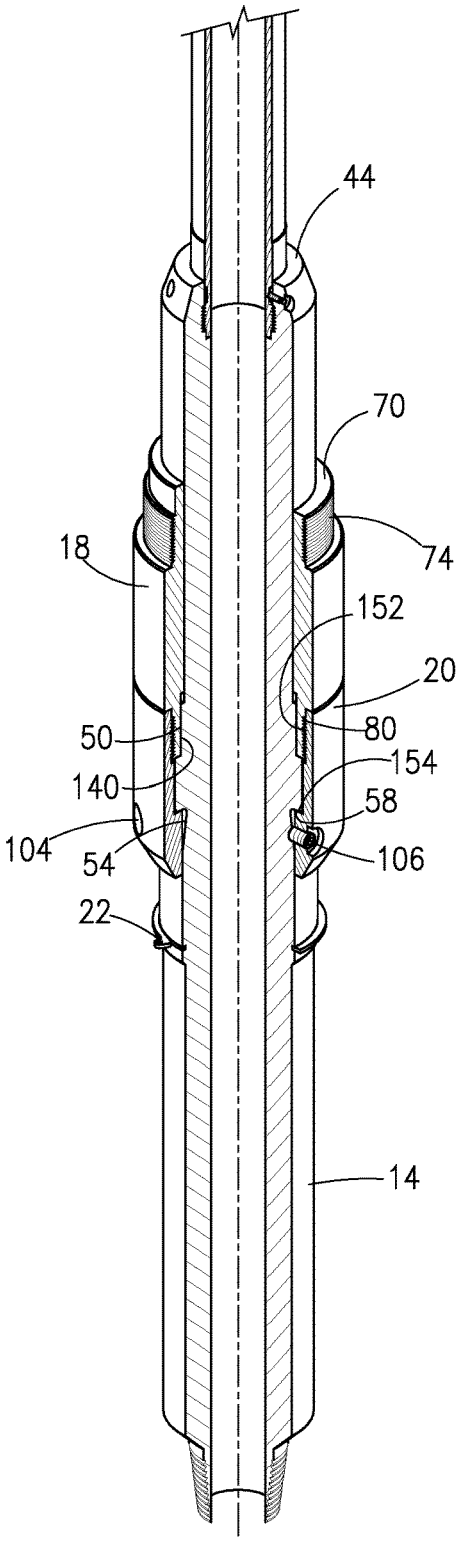

FIG. 4A illustrates inner faceted portion 140 at a lower end of an inner bore of orienting sleeve 18. Inner faceted portion 140 is configured to engage outer faceted portion 50 of lower sub 14. Inner faceted portion 140 may include a plurality of flat surfaces around the circumference of the inner bore of orienting sleeve 18. Outer and inner faceted portions 50, 140 may include the same number of flat surfaces. Outer and inner faceted portions 50, 140 may include any number of flat surfaces, such as, but not limited to, between 2 and 70 flat surfaces each. In one embodiment, outer and inner faceted portions 50, 140 each include 24 flat surfaces such that the flat surfaces are separated by 15 degrees. This configuration allows alignment between upper and lower subs 12, 14 and between the upper and lower members within 7.5 degrees of variance. In other embodiments, outer and inner faceted portions 50, 140 may include any repetitive shape allowing incremental rotation, such as, but not limited to, a gear shape or a star shape.

FIG. 4A also illustrates inner bore 142 of upper sub 12. Inner bore 142 includes expanded diameter section 144 configured to receive mandrel 110 and a portion of lower sub 14 therein. Expanded diameter section 144 may include tapered surface 146 configured to engage tapered surface 48 at upper end 44 of lower sub 14. Inner bore 142 may also include one or more grooves 148 configured to house one or more seal members 118 therein. The first step of the assembly process for orientation system 10 may include positioning seal members 118 in grooves 148.

With reference to FIGS. 5A-6B, the second step in the assembly process for orientation system 10 includes disconnecting orienting sleeve 18 from upper sleeve 16 and upper sub 12. Set screws 96 may be loosened to disengage tapered surface 36 of upper sub 12. Upper sleeve 16 may be disconnected from orienting sleeve 18 by disconnecting threaded lower end 136 of upper sleeve 16 from threaded upper portion 74 of orienting sleeve 18. In this way, orienting sleeve 18 may be operatively disconnected from upper sub 12. Upper sleeve 16 may then be lifted along upper sub 12 to expose keyed lower surface 34, and set screws 96 may be tightened against outer surface 30 of upper sub 12 to secure upper sleeve 16 in this position around upper sub 12.

Figure 13:
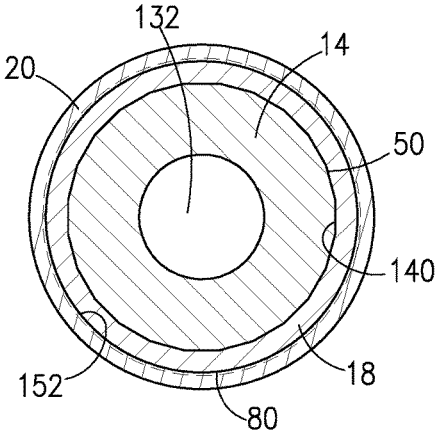
FIG. 13 is a lateral sectional view of the orientation system taken along line 13-13 in FIG. 5B.
Figure 14:
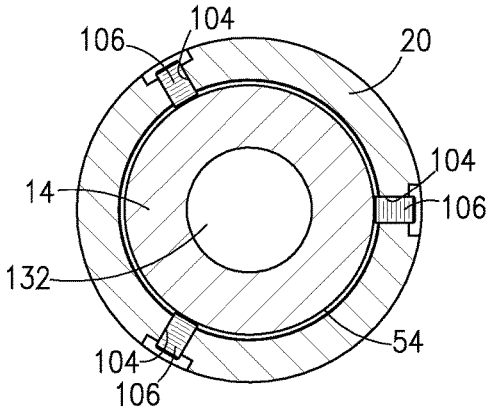
FIG. 14 is a lateral sectional view of the orientation system taken along line 14-14 in FIG. 5B.

The second step of the assembly process may also include sliding orienting sleeve 18 over mandrel 110 and upper end 44 of lower sub 14. With alignment mark 139 of orienting sleeve 18 in line with alignment mark 134 of lower sub 14, inner faceted portion 140 of orienting sleeve 18 may engage outer faceted portion 50 of lower sub 14 as shown in FIG. 13. In this way, orienting sleeve 18 is rotationally positioned relative to the rotational position of lower sub 14 such that orienting sleeve 18 does not rotate relative to lower sub 14. Lower sleeve 20 may then be lifted along lower sub 14 and threadedly connected to orienting sleeve 18 by connecting threaded upper end 152 of lower sleeve 20 to threaded lower end 80 of orienting sleeve 18 also shown in FIG. 13. Set screws 106 may then be fully tightened within lateral bores 104 such that set screws 106 engage tapered section 54 of lower sub 14 as shown in FIG. 14. In this way, set screws 106 retain lower sleeve 20 around lower sub 14 with inner shoulder 154 of lower sleeve 20 engaging lower shoulder 58 of lower sub 14, thereby operatively connecting orienting sleeve 18 to lower sub 14 with alignment mark 139 in line with alignment mark 134. In this arrangement, it is not possible for lower sleeve 20 to unthread from orienting sleeve 18 due to the direction of tapered section 54 of lower sub 14 (i.e., the diameter of tapered section 54 decreases in the threading direction).

Figure 7A:
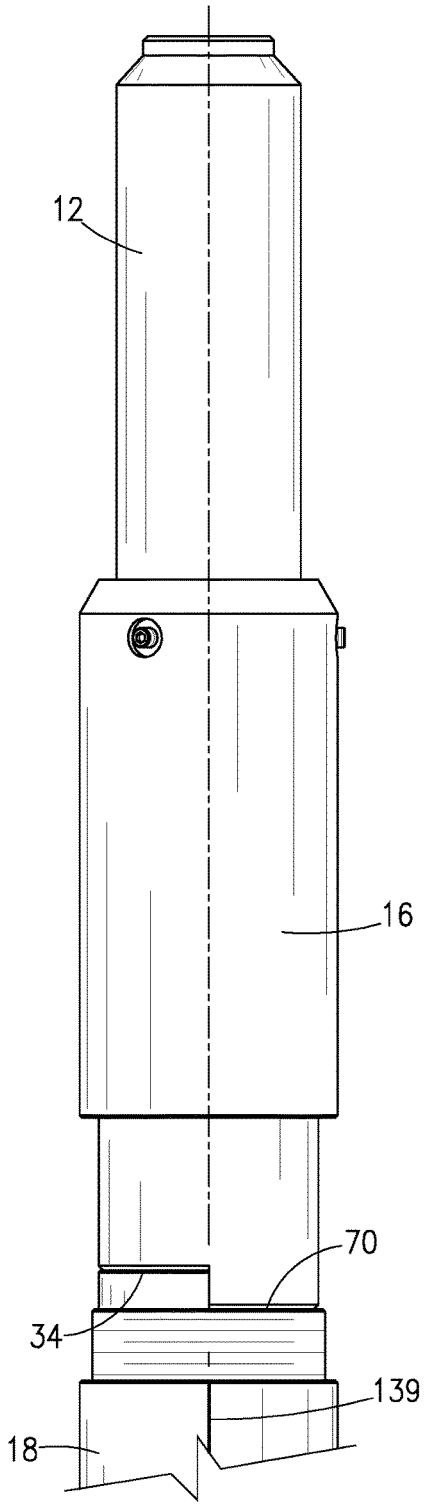
FIGS. 7A and 7B show a sequential side view of the orientation system after a third step in the assembly process.
Figure 7B:
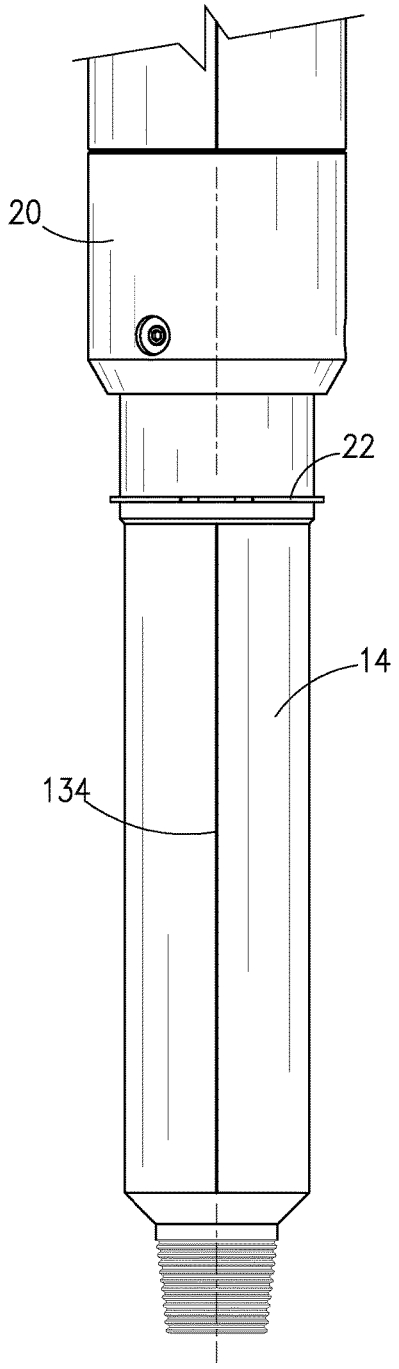
Figure 8A:
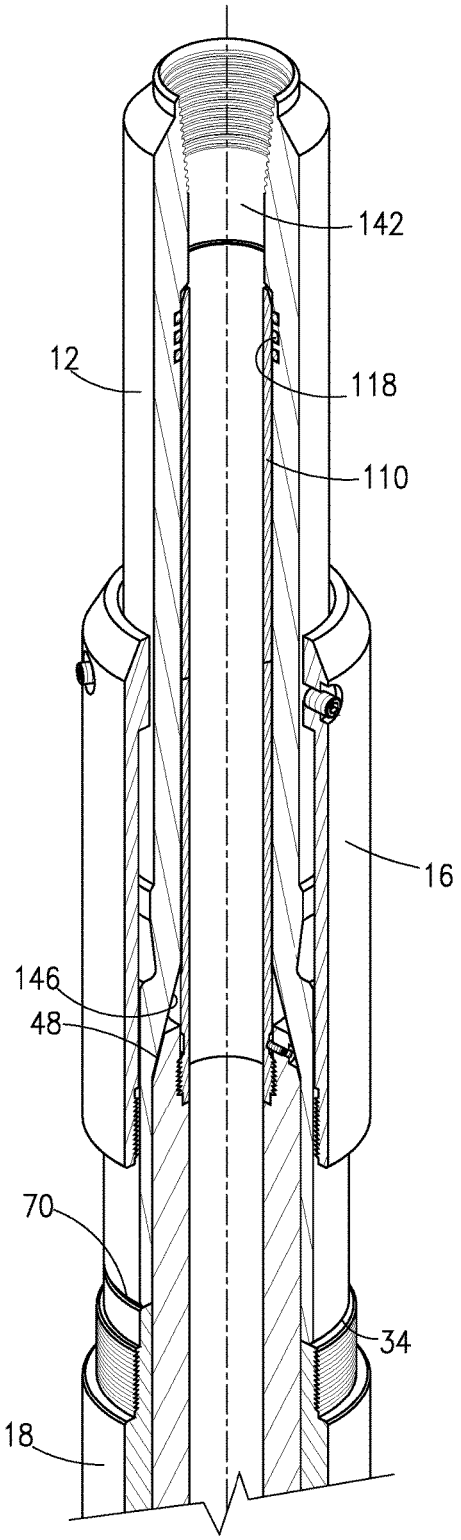
FIGS. 8A and 8B show a sequential perspective cutaway view of the orientation system after the third step in the assembly process.
Figure 8B:
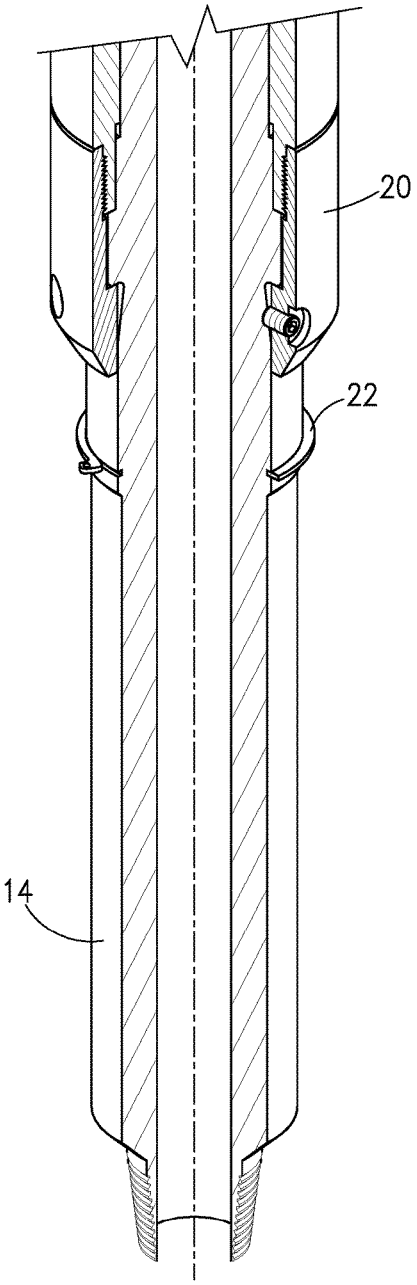
Figure 9A:
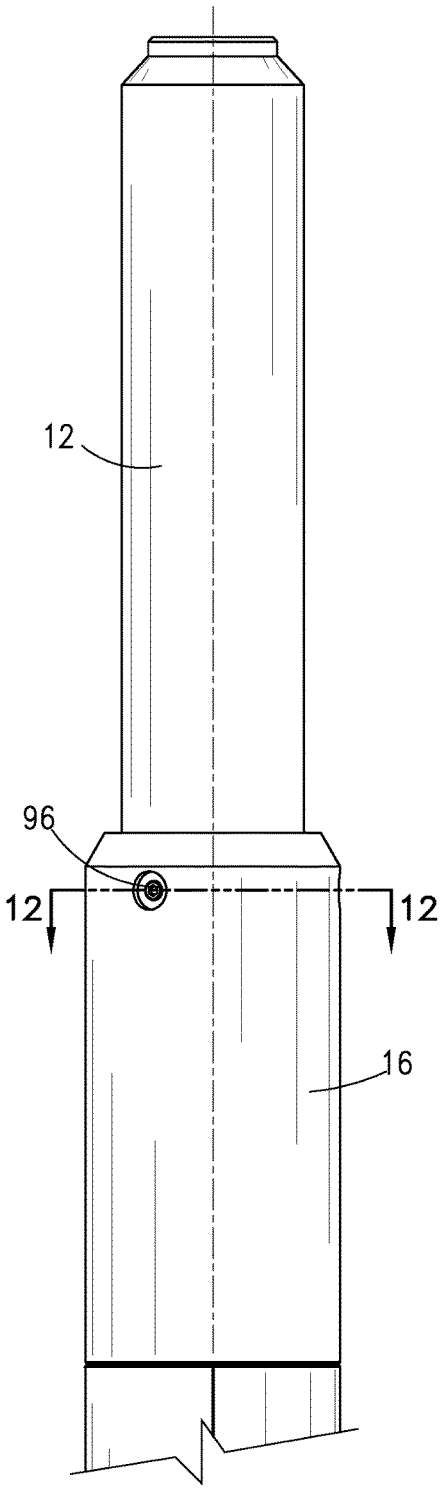
FIGS. 9A and 9B show a sequential side view of the orientation system after a fourth step in the assembly process.
Figure 9B:
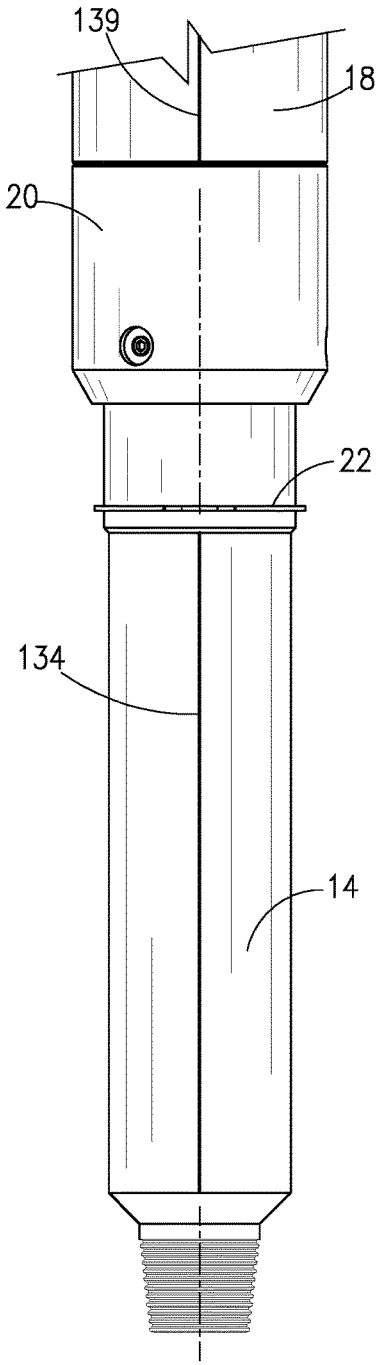
Figure 10A:
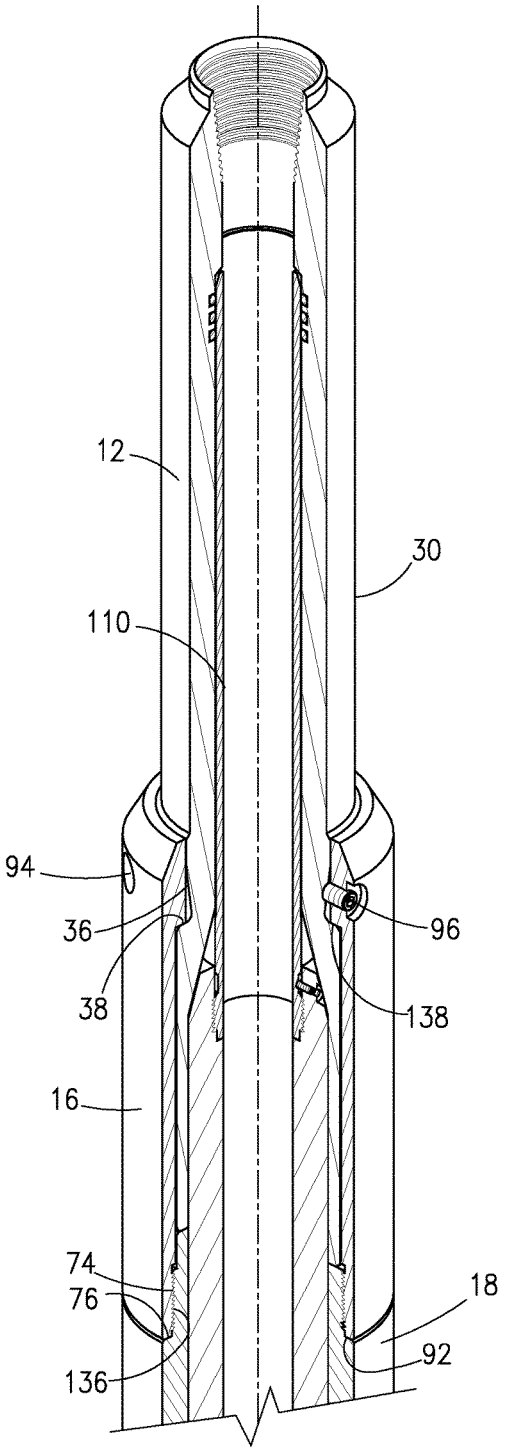
FIGS. 10A and 10B show a sequential perspective cutaway view of the orientation system after the fourth step in the assembly process.
Figure 10B:
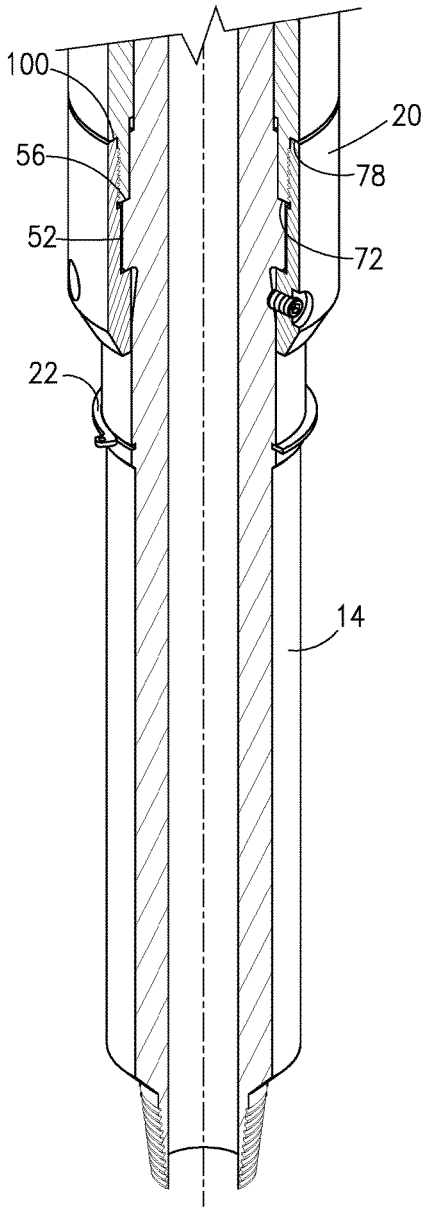

Referring now to FIGS. 7A-8B, the third step in the assembly process for orientation system 10 includes sliding upper sub 12 with upper sleeve 16 over mandrel 110 and lower sub 14 with upper sub 12 rotationally positioned to allow keyed lower surface 34 of upper sub 12 to engage keyed upper surface 70 of orienting sleeve 18 as shown in FIGS. 7A and 8A. In this position, mandrel 110 and lower sub 14 are positioned within expanded diameter section 144 of inner bore 142, with tapered surface 48 of lower sub 14 engaging tapered surface 146 of inner bore 142. An upper end of mandrel 110 may engage a shoulder within inner bore 142 of upper sub 12. Seal members 118 may engage an outer surface of mandrel 110 to provide a fluid seal between inner bore 142 of upper sub 12 and mandrel 110.

Figure 12:
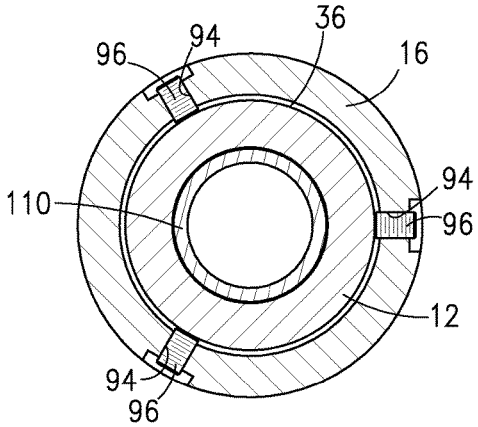
FIG. 12 is a lateral sectional view of the orientation system taken along line 12-12 in FIG. 9A.

With reference to FIGS. 9A-10B, the fourth step in the assembly process for orientation system 10 includes loosening set screws 96 within lateral bores 94 of upper sleeve 16 to disengage outer surface 30 of upper sub 12, thereby allowing upper sleeve 16 to slide along upper sub 12. Upper sleeve 16 may then be lowered to orienting sleeve 18, and again connected to orienting sleeve 18 by threadedly connecting threaded lower end 136 of upper sleeve 16 to threaded upper portion 74 of orienting sleeve 18. Set screws 96 may then be fully tightened within lateral bores 94 of upper sleeve 16 such that set screws 96 engage tapered section 36 of upper sub 12 as shown in FIG. 12. In this way, set screws 96 retain upper sleeve 16 around upper sub 12 with inner shoulder 138 of upper sleeve 16 engaging shoulder 38 of upper sub 12. In this position, bottom surface 92 of upper sleeve 16 engages upper shoulder 76 of orienting sleeve 18, top surface 100 of lower sleeve 20 engages lower shoulder 78 of orienting sleeve 18, and upper shoulder 56 of lower sub 14 engages lower surface 72 of orienting sleeve 18, thereby retaining orienting sleeve 18 relative to upper and lower subs 12, 14. In this arrangement, it is not possible for upper sleeve 16 to unthread from orienting sleeve 18 due to the direction of tapered section 36 of upper sub 12 (i.e., the diameter of tapered section 36 decreases in the threading direction). Similarly, it is not possible for lower sleeve 20 to unthread from orienting sleeve 18 due to the direction of tapered section 54 of lower sub 14 (i.e., the diameter of tapered section 54 decreases in the threading direction).

In the connected position shown in FIGS. 9A-10B, alignment mark 139 of orienting sleeve 18 is again aligned with the rotational position of the upper member attached to upper sub 12. Similarly, alignment mark 134 of lower sub 14 is aligned with the rotational position of the lower member to which it is attached. Because alignment mark 139 is in line with alignment mark 134, the upper member and the lower member are aligned with one another in the connected position at the conclusion of the assembly process of orientation system 10.

In an alternate embodiment, the assembly process of orientation system 10 may be used to rotationally offset the upper member from the rotational position of the lower member. In this embodiment, alignment mark 139 may be made on orienting sleeve 18 at the desired rotationally offset position from the rotational position of the upper member, or alignment mark 134 may be made on lower sub 14 at the desired rotationally offset position from the rotational position of the lower member. Thereafter, orienting sleeve 18 may be positioned around lower sub 14 to place alignment mark 139 in line with alignment mark 134. Alternatively, alignment marks 139 and 134 may be made on orienting sleeve 18 and lower sub 14 in line with the rotational position of the upper member and the lower member, respectively, and orienting sleeve 18 may be positioned around lower sub 14 to place alignment mark 139 in the desired rotationally offset position relative to alignment mark 134.

Figure 15:
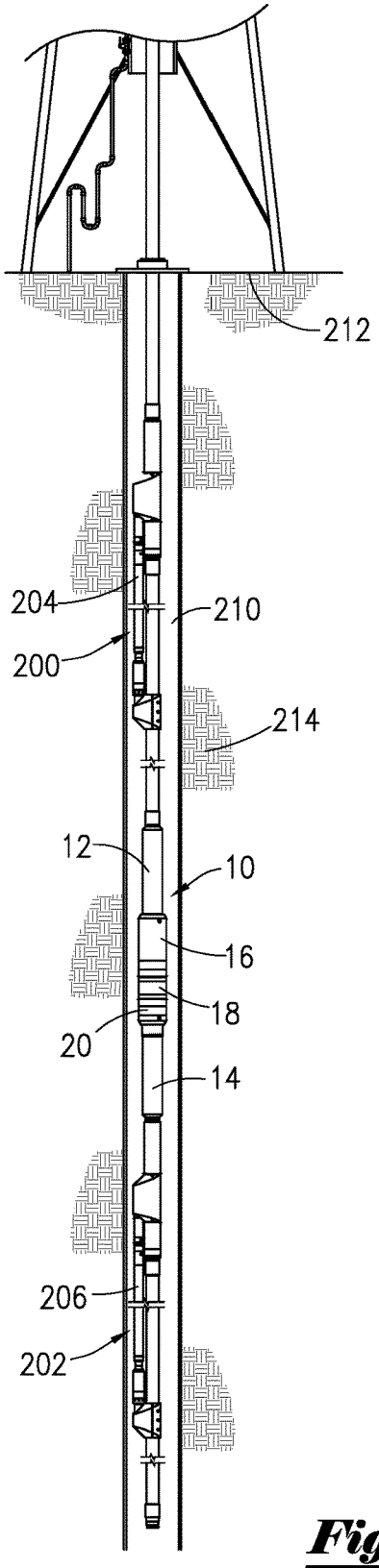
FIG. 15 is a schematic view of the orientation system connected between an upper member and a lower member within a wellbore.

Orientation system 10 may be used with two or more perforating tools as shown in FIG. 15. Upper sub 12 may be attached to upper perforating tool 200 with a desired torque value, and lower sub 14 may be attached to lower perforating tool 202 with a desired torque value using the assembly process described above. With orienting sleeve 18 connected to upper sleeve 16 and upper sub 12 in the first step of the assembly process, an upper alignment mark may be made on orienting sleeve 18 such that the upper alignment mark is aligned with upper perforating gun 204 of upper perforating tool 200. Similarly, a lower alignment mark may be made on lower sub 14 such that the lower alignment mark is aligned with lower perforating gun 206 of lower perforating tool 202. Orienting sleeve 18 may be disconnected from upper sleeve 16 and upper sub 12, and connected to lower sub 14 and lower sleeve 20 with orienting sleeve 18 rotationally positioned such that the upper alignment mark is aligned with the lower alignment mark. Thereafter, upper sub 12 with attached upper perforating tool 200 may be connected to lower sub 14 with the keyed lower surface of upper sub 12 engaging the keyed upper surface of orienting sleeve 18 such that upper perforating gun 204 is aligned with lower perforating gun 206. Finally, upper sleeve 16 may be secured to orienting sleeve 18 to secure the connection between upper and lower subs 12 and 14, thereby securing the connection between upper and lower perforating tools 200 and 202. In this way, orientation system 10 may be used to secure upper perforating tool 200 to lower perforating tool 202 with high torque and to achieve a desired rotational position of upper perforating tool 200 relative to the rotational position of lower perforating tool 202.

Referring still to FIG. 15, upper perforating tool 200, orientation system 10, and lower perforating tool 202 may be positioned in wellbore 210 extending from ground surface 212 into subterranean formation 214. With upper perforating gun 204 and lower perforating gun 206 aligned as described above, a charge applied to upper perforating gun 204 may be applied in the same plane as a charge applied to lower perforating gun 206. Because of the high torque connection allowed by orientation system 10, perforating guns 204, 206 are aligned and the connection between upper perforating tool 200 and lower perforating tool 202 is resistant to loosening from the vibrations of the perforating gun charges.

In an alternate embodiment, the orientation system includes an orienting sleeve without an upper sleeve or a lower sleeve. In this embodiment, the orienting sleeve includes a load bearing connection to the upper sub and a load bearing connection to the lower sub. In this way, the orienting sub retains the connection between the upper and lower subs in addition to rotationally aligning the upper sub and the upper member with the lower sub and the lower member.

The connection arrangement with set screws (such as set screws 96, 106) engaging a tapered surface (such as tapered sections 36, 54) may be used in other situations to maintain a threaded connection between a tubular member (such as upper or lower sub 12, 14) and an outer sleeve (such as upper or lower sleeve 16, 20) disposed over the tubular member. In other applications, a tubular member may include an outer surface having a threaded section and a tapered section, with a diameter of the tapered section decreasing in a threading direction. An outer sleeve is dimensioned to fit over the tubular member. The outer sleeve may include an inner surface having a threaded section configured to engage the threaded section of the tubular member. The outer sleeve also includes a lateral bore configured to receive a set screw therethrough to engage the tapered section of the tubular member for securing the outer sleeve to the tubular member. The outer sleeve is prevented from unthreading from the tubular member due to the direction of the tapered section of tubular member (i.e., the diameter of the tapered section decreases in the threading direction).

While preferred embodiments have been described, it is to be understood that the embodiments are illustrative only and that the scope of the invention is to be defined solely by the appended claims when accorded a full range of equivalents, many variations and modifications naturally occurring to those skilled in the art from a review hereof.

We claim:

1. An orientation system comprising:

an upper sub including an outer surface extending from an upper end to a keyed lower surface;

a lower sub slidingly engaging the upper sub, the lower sub including an outer surface extending from an upper end to a lower end, the outer surface including an outer faceted portion; and an orienting sleeve disposed around the lower sub, the orienting sleeve including a keyed upper surface and an inner bore with an inner faceted portion, wherein the inner faceted portion engages the outer faceted portion of the lower sub and the keyed upper surface engages the keyed lower surface of the upper sub to rotationally orient the upper sub relative to a rotational position of the lower sub.

2. The orientation system of claim 1, wherein the keyed lower surface of the upper sub includes at least two shoulders, and the keyed upper surface of the orienting sleeve includes at least two shoulders each engaging one of the shoulders of the keyed lower surface of the upper sub.

3. The orientation system of claim 1, wherein the outer surface of the lower sub further includes an expanded section below the outer faceted portion, the expanded section forming an upper shoulder and a lower shoulder, and wherein a lower surface of the orienting sleeve engages the upper shoulder of the lower sub.

4. The orientation system of claim 3, wherein the orienting sleeve further comprises an outer surface having a threaded upper portion and a threaded lower end, and wherein the orientation system further comprises:

an upper sleeve disposed above the orienting sleeve and around the upper sub, the upper sleeve including an internal shoulder engaging a shoulder on the outer surface of the upper sub, the upper sleeve further including a threaded lower end engaging the threaded upper portion of the orienting sleeve; and a lower sleeve disposed below the orienting sleeve and around the lower sub, the lower sleeve including a threaded upper end engaging the threaded lower end of the orienting sleeve and an internal shoulder engaging the lower shoulder of the lower sub.

5. The orientation system of claim 4, wherein the outer surface of the orienting sleeve includes an upper shoulder and a lower shoulder between the threaded upper portion and the threaded lower end, the upper shoulder engaging a bottom surface of the upper sleeve and the lower shoulder engaging a top surface of the lower sleeve.

6. The orientation system of claim 5, wherein the outer surface of the upper sub includes a tapered section above the shoulder, and wherein the upper sleeve includes a lateral bore configured to receive a set screw therethrough to engage the tapered section of the upper sub for securing the upper sleeve and the orienting sleeve to the upper sub.

7. The orientation system of claim 6, wherein the outer surface of the lower sub further includes a tapered section below the lower shoulder, and wherein the lower sleeve includes a lateral bore configured to receive a set screw therethrough to engage the tapered section of the lower sub for securing the lower sleeve and the orienting sleeve to the lower sub.

8. The orientation system of claim 7, further comprising a retaining mechanism configured to fit into a groove in the outer surface of the lower sub below the outer faceted portion to retain the lower sleeve around the lower sub.

9. The orientation system of claim 1, wherein the upper sub includes an inner bore having a lower expanded diameter section, and the lower sub is disposed within the lower expanded diameter section of the inner bore of the upper sub.

10. The orientation system of claim 9, wherein a tapered surface of the lower sub engages a tapered surface of the lower expanded diameter section of the inner bore of the upper sub.

11. The orientation system of claim 9, further comprising a mandrel operatively connected to the upper end of the lower sub and disposed within the lower expanded diameter section of the inner bore of the upper sub.

12. The orientation system of claim 11, wherein the mandrel is threadedly connected to an upper end of an inner bore of the lower sub.

13. An orientation system comprising:

an upper sub including an outer surface extending from an upper end to a keyed lower surface, the outer surface having a tapered section above a shoulder;

a lower sub slidingly engaging the upper sub, the lower sub including an outer surface extending from an upper end to a lower end, the outer surface including an outer faceted portion, an expanded section, and a tapered section, the expanded section forming an upper shoulder and a lower shoulder each above the tapered section;

an orienting sleeve disposed around the lower sub, the orienting sleeve including a keyed upper surface, an outer surface extending from a threaded upper portion to a threaded lower end, and an inner bore with an inner faceted portion, wherein the inner faceted portion engages the outer faceted portion of the lower sub and the keyed upper surface engages the keyed lower surface of the upper sub to rotationally orient the upper sub relative to a rotational position of the lower sub;

an upper sleeve disposed above the orienting sleeve and around the upper sub, the upper sleeve including an internal shoulder engaging the shoulder of the upper sub, the upper sleeve further including a threaded lower end engaging the threaded upper portion of the orienting sleeve, wherein the upper sleeve includes a lateral bore configured to receive a set screw therethrough to engage the tapered section of the upper sub for securing the upper sleeve and the orienting sleeve to the upper sub; and a lower sleeve disposed below the orienting sleeve and around the lower sub, the lower sleeve including an internal shoulder engaging the lower shoulder of the lower sub, the lower sleeve further including a threaded upper end engaging the threaded lower end of the orienting sleeve, wherein the lower sleeve includes a lateral bore configured to receive a set screws therethrough to engage the tapered section of the lower sub for securing the lower sleeve and the orienting sleeve to the lower sub.

14. The orientation system of claim 13, wherein the keyed lower surface of the upper sub includes at least two shoulders, and the keyed upper surface of the orienting sleeve includes at least two shoulders each engaging one of the shoulders of the keyed lower surface of the upper sub.

15. The orientation system of claim 13, further comprising a retaining mechanism configured to fit into a groove in the outer surface of the lower sub below the tapered portion to retain the lower sleeve around the lower sub.

16. The orientation system of claim 13, wherein the upper sub includes an inner bore having a lower expanded diameter section, and the lower sub is disposed within the lower expanded diameter section of the inner bore of the upper sub.

17. The orientation system of claim 16, further comprising a mandrel operatively connected to the upper end of the lower sub and disposed within the lower expanded diameter section of the inner bore of the upper sub.

18. A method of rotationally orienting an upper member relative to a lower member, comprising the steps of:

a) providing an orientation system comprising: an upper sub including an outer surface extending from an upper end to a keyed lower surface, the outer surface having a tapered section above a shoulder; a lower sub slidingly engaging the upper sub, the lower sub including an outer surface extending from an upper end to a lower end, the outer surface including an outer faceted portion, an expanded section, a tapered section, and a groove, the expanded section forming an upper shoulder and a lower shoulder; an orienting sleeve configured to be disposed around the lower sub, the orienting sleeve including a keyed upper surface, an outer surface extending from a threaded upper portion to a threaded lower end, and an inner bore with an inner faceted portion, wherein the inner faceted portion is configured to engage the outer faceted portion of the lower sub and the keyed upper surface is configured to engage the keyed lower surface of the upper sub to rotationally orient the upper sib relative to a rotational position of the lower sub; an upper sleeve configured to be disposed above the orienting sleeve and around the upper sub, the upper sleeve including an internal shoulder configured to engage the shoulder of the upper sub, the upper sleeve further including a threaded lower end configured to engage the threaded upper portion of the orienting sleeve; a lower sleeve configured to be disposed below the orienting sleeve and around the lower sub, the lower sleeve including an internal shoulder configured to engage the lower shoulder of the lower sub, the lower sleeve further including a threaded upper end configured to engage the threaded lower end of the orienting sleeve; and a retaining mechanism configured to fit into the groove in the outer surface of the lower sub;

b) sliding the upper sleeve over the upper sub, and threadedly connecting the orienting sleeve to the upper sleeve by engaging the threaded lower end of the upper sleeve with the threaded upper portion of the orienting sleeve;

c) sliding the lower sleeve over the lower sub, and securing the retaining mechanism in the groove of the outer surface of the lower sub to retain the lower sleeve around the lower sub;

d) attaching the lower sub to a lower member, and attaching the upper sub to an upper member;

e) threadedly disconnecting the orienting sleeve from the upper sleeve;

f) sliding the orienting sleeve over the lower sub to engage the outer faceted portion of the lower sub with the inner faceted portion of the orienting sleeve to rotationally orient the orienting sleeve relative to a rotational position of the lower sub and the lower member;

g) threadedly connecting the lower sleeve to the orienting sleeve by engaging the threaded lower end of the orienting sleeve with the threaded upper end of the lower sleeve;

h) sliding upper sub over the upper end of the lower sub to engage the keyed upper surface of the orienting sleeve with the keyed lower surface of the upper sub to rotationally orient the upper sub relative to the rotational position of the lower sub;

i) threadedly connecting the upper sleeve to the orienting sleeve by engaging the threaded upper portion of the orienting sleeve with the threaded lower end of the upper sleeve.

19. The method of claim 18, further comprising the steps of:

d1) adding a lower alignment mark to the outer surface of the lower sub, wherein the alignment mark is aligned with a component of the lower member;

d2) adding an upper alignment mark to the outer surface of the orienting sleeve, wherein the alignment mark is aligned with a component of the upper member;

wherein step (f) further comprises rotationally positioning the orienting sleeve to align the upper alignment mark on the orienting sleeve with the lower alignment mark on the lower sub.

20. The method of claim 19, wherein the upper sleeve and the lower sleeve each includes a lateral bore configured to receive a set screw therethrough, the method further comprising the steps of:

g1) positioning a first set screw through the lateral bore in the lower sleeve, and engaging the tapered section of the lower sub with the first set screw to secure the lower sleeve and the orienting sleeve to the lower sub; and i1) positioning a second set screw through the lateral bore in the upper sleeve, and engaging the tapered section of the upper sub with the second set screw to secure the upper sleeve and the orienting sleeve to the upper sub.

* * * * *